United States Patent [19]

Falendysz et al.

[11] 4,431,381

[45] Feb. 14, 1984

[54] VARIABLE VOLUME HYDRAULIC PUMP

[75] Inventors: Eugene L. Falendysz; Eldon M. Brumbaugh, both of Racine, Wis.

[73] Assignee: J. I. Case Company, Racine, Wis.

[21] Appl. No.: 325,527

[22] Filed: Nov. 27, 1981

[51] Int. Cl.[3] ..... F04B 47/08; F04B 7/04

[52] U.S. Cl. ..... 417/289; 417/307; 417/490

[58] Field of Search ..... 417/289, 284, 307, 490

[56] References Cited

U.S. PATENT DOCUMENTS 2,732,805 1/1956 Lucien ..... 417/289 X
3,519,370 7/1970 Bleuel ..... 417/490 X

FOREIGN PATENT DOCUMENTS 1956546 5/1971 Fed. Rep. of Germany ..... 417/490
706863 4/1954 United Kingdom ..... 417/289

*Primary Examiner*—Richard E. Gluck
*Attorney, Agent, or Firm*—Cullen, Sloman, Cantor, Grauer, Scott & Rutherford

[57] ABSTRACT

A variable volume pump for satisfying the requirements of a hydraulic system while absorbing excess fluid volume when the full volume of fluid displacement from the pump is not required by the hydraulic system. The pump includes one or more lines of reciprocable pistons mounted radially around a crankshaft. The rotation of the crankshaft results in centrifugal flow of fluid through crankpin apertures for filling the pistons. Each piston includes a cylindrical tube portion which is slidably movable within a metering sleeve. The metering sleeve is spring biased towards a position for covering metering ports that are located around the periphery of the piston tube portion. When the fluid pressure in the hydraulic system acting on a metering sleeve abutment area exceeds the force of the metering sleeve spring, the metering sleeve moves thereby uncovering the piston metering ports. The movement of the metering sleeve permits the piston to travel an equal distance with its metering ports open. This results in the displacement of a fluid volume to a low pressure cavity within the pump until the piston metering ports are again closed by the metering sleeve. Thus, fluid flow from the pump is reduced in proportion to increased system pressure until a maximum desired output pressure is reached with minimum fluid flow.

1 Claim, 2 Drawing Figures

VARIABLE VOLUME HYDRAULIC PUMP

BACKGROUND OF THE INVENTION

The present invention relates to an improved fixed displacement pump arrangement for satisfying the requirements of a hydraulic system while requiring less power to operate during low demand conditions, and more particularly, to a pump construction which absorbs excess fluid volume when the full volume of fluid displacement from the pump is not required by the hydraulic system.

It is common in earth-moving equipment, such as front end loaders, backhoes or the like, to have a bucket or a shovel mounted on a tractor to be raised and lowered, tilted, or otherwise moved into the correct attitude by an appropriate mechanism for the work being performed at the moment. Such adjustments of the bucket or shovel are commonly made by hydraulic cylinders supplied with fluid pressure from a suitable pump.

A common mode of operation in earth-working is to move a bucket or shovel into a pile of material. The hydraulic systems for such earth-working applications require a high volume of fluid at low pressure to rapidly move the cylinder piston rods and, therefore, the bucket or shovel to the work. Then, low fluid volume under high pressure must be available to provide the necessary tilting of the bucket or shovel to break a portion of the material loose from the work pile or lift the material in the bucket or shovel.

One of the prior art approaches has been to provide a fixed displacement pump to supply the required fluid under pressure with the excess being discharged through a relief valve. It is a common arrangement to use the tractor engine for driving the pump, and the pump is normally continuously delivering its maximum amount of fluid because the tractor engine runs at a governed speed. Much of the time, the full volume of fluid is not required, and the excess fluid power must be absorbed by the system in the form of undesired heating and wear on the relief valve.

Another prior art approach has been to utilize a variable displacement pump in connection with automatic controls so that the output of the pump can be maintained at a minimum except when further output is demanded by the system. A system so equipped demands less power to operate the hydraulic system, reduces the heat rise in the fluid when operating in a low demand condition, permits a possible reduction in capacity of an oil cooler, and reduces pump and relief valve noise under low demand conditions.

A major disadvantage to the use of a variable displacement pump is cost. A variable displacement pump is significantly more expensive than a comparable fixed displacement pump, increasing the overall expense of manufacturing earth-working machines such as backhoes and front-end loaders.

Thus, there has been a need for an improved fixed displacement pump arrangement which is capable of absorbing excess fluid volume during low demand operation, thereby requiring less power to operate while being less expensive than a comparable variable displacement pump.

SUMMARY OF THE INVENTION

The variable volume pump of the present invention may be used with conventional earth-working equipment including front-end loaders and backhoes. The pump is intended to satisfy the demands of a hydraulic system such as used in front-end loaders and backhoes wherein a high volume of fluid is required at low pressure for rapid traverse up to the work and then low volume, high pressure fluid is required for clamping, feeding or pressing. It is understood that the pump arrangement of the present invention may be used in other environments having similar requirements.

A hydraulic system equipped with the pump arrangement of the present invention demands less power to operate and aids in the reduction of heat rise in the fluid during low demand operation.

The hydraulic pump of the present invention includes a housing with one or more lines of reciprocable pistons mounted radially around a crankshaft. The crankshaft is substantially hollow and includes a number of cam lobes or crankpins. Each piston is mounted on a respective crankpin by a free riding slipper. An enlarged spherical end or head with an axial drilling therethrough allows fluid flow in through the piston head for filling the piston with fluid.

The hydraulic fluid is fed through a conduit into the interior of the crankshaft. The rotation of the crankshaft results in centrifugal flow of the fluid through crankpin apertures which causes filling of the pistons. As each piston reciprocates, fluid under pressure is discharged to a conventional hydraulic circuit such as used in earth-working equipment.

Each piston includes a cylindrical tube portion which is slidably movable within a metering sleeve. As the piston moves upwardly, the fluid volume filling the tube portion is directed against a check valve. When the fluid pressure in the tube portion exceeds the preload on the check valve, the check valve is forced off its seat thereby permitting fluid to be discharged to the hydraulic system.

Each piston includes a plurality of metering ports around the periphery of its tube portion. The metering sleeve is spring biased and includes a throttling land formed at its end for covering the piston metering ports. The pressure in the hydraulic system is communicated against an annular abutment on the metering sleeve. If the fluid pressure in the hydraulic system exceeds the preload on the metering sleeve, the metering sleeve moves in an upward direction changing the relative position of its throttling land with respect to the piston metering ports.

The upward movement of the metering sleeve permits the piston to travel an equal distance with its metering ports uncovered. This results in the displacement of a fluid volume to a low pressure cavity within the pump which is equivalent to the fluid volume displaced by the piston during its upward travel with the metering ports open. As the piston moves within the displaced metering sleeve, the metering ports are again closed by the throttling land thereby blocking off fluid flow to the low pressure cavity. Thereafter, the remaining fluid flow resulting from the upward stroke of the piston is discharged to the hydraulic system.

The adjustable metering sleeve is moved to its maximum upward position when the pressure in the hydraulic system reaches a maximum predetermined level. The only flow to the hydraulic system at the maximum desired system pressure is that necessary to maintain the desired pressure. All other flow will be diverted through the piston metering ports to the low pressure cavity within the pump. Thus, each piston delivers its full fluid volume to the hydraulic system until the pressure in the hydraulic system offsets the preload pressure on the metering sleeve. Then, the fluid flow to the hydraulic system is reduced in proportion to increased system pressure until a maximum desired output pressure is reached with minimum fluid flow.

Other advantages and meritorious features of the variable volume pump of the present invention will be more fully understood from the following description of the preferred embodiment, the appended claims, and the drawings, a brief description of which follows.

DETAILED DESCRIPTION OF THE INVENTION

Figure 1:
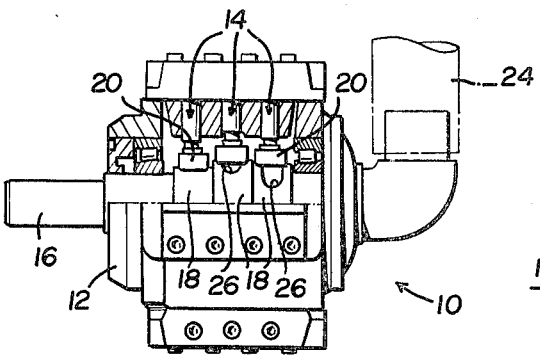
FIG. 1 is a side elevational view of the variable volume pump with a portion cut away for easier viewing.
Figure 2:
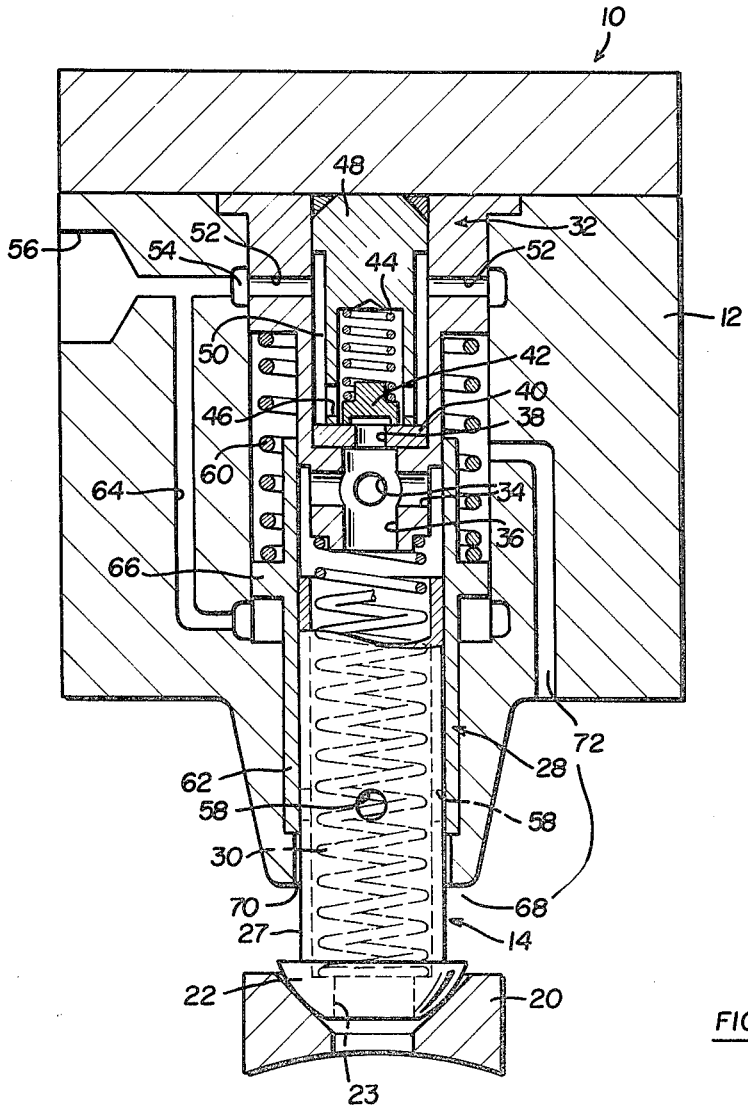
FIG. 2 is an enlarged fragmentary view of a piston assembly for the pump including the adjustable metering sleeve.

A preferred embodiment of the variable volume hydraulic pump made in accordance with the teachings of the present invention is illustrated in FIGS. 1–2.

Referring to FIGS. 1–2, hydraulic pump 10 includes a housing 12 with one or more lines of reciprocable pistons 14 mounted radially around a crankshaft 16. Crankshaft 16 is substantially hollow and includes a number of cam lobes or crankpins 18. Each piston 14 is mounted on a respective crankpin by a free riding slipper 20. An enlarged spherical end or head 22 with an axial drilling 23 therethrough allows fluid flow in through the piston head for filling the piston with fluid.

The hydraulic fluid is fed through conduit 24 into the interior of crankshaft 16. The rotation of crankshaft 16 results in centrifugal flow of the fluid through crankpin apertures 26 which causes filling of pistons 14. As each piston 14 reciprocates, fluid under pressure is discharged to a conventional hydraulic circuit (not shown) such as used in earth-working equipment.

Each piston 14 includes a cylindrical tube portion 27 which is slidably movable within a metering sleeve 28. A return spring 30 is mounted within piston tube portion 27 in abutting engagement against one end of sleeve 32 for holding piston 14 in position on slipper 20. As piston 14 moves upwardly, the fluid volume filling tube portion 27 is delivered through openings 34 and 36 into the lower end of sleeve 32. The fluid under pressure entering sleeve 32 is directed through opening 38 in seat 40 against check valve 42.

As is conventional, the fluid which enters tube portion 27 through crankpin aperture 26 is prevented from being discharged through aperture 26 during upward movement of piston 14. When piston 14 is at bottom dead center of its stroke, crankpin aperture 26 is in communication with tube portion 27 through axial drilling 23. However, when crankpin 18 rotates and fluid piston 14 moves upwardly, the communication between tube portion 27 and aperture 26 is broken thereby preventing fluid from being discharged through aperture 26.

When the fluid pressure in tube portion 27 exceeds the preload of spring 44, check valve 42 is forced off seat 40 thereby permitting fluid to pass through openings 46 in sleeve 48 and into the annular chamber 50 between sleeves 32 and 48. Fluid under pressure is then discharged through openings 52 in sleeve 32 into annular cavity 54 and out through discharge port 56 to the hydraulic system (not shown).

Piston 14 includes a plurality of metering ports 58 around the periphery of tube portion 27. When spring 60 is holding metering sleeve 28 in the position shown in FIG. 2 and piston 14 is at its maximum downward position, metering ports 58 are completely covered or closed by the throttling land 62 formed at the end of metering sleeve 28. The pressure in the hydraulic system is communicated through fluid line 64 against annular abutment 66 on metering sleeve 28. If the fluid pressure in line 64 acting on abutment 66 exceeds the preload of spring 60, metering sleeve 28 moves in an upward direction changing the relative position of throttling land 62 with respect to the metering ports 58 in piston 14.

The upward movement of metering sleeve 28 permits piston 14 to travel an equal distance with its metering ports 58 uncovered. This results in the displacement of a fluid volume to low pressure cavity 68 within pump 10 which is equivalent to the fluid volume displaced by piston 14 during its upward travel with ports 58 open. The fluid being displaced to low pressure cavity 68 by piston 14 passes through metering ports 58 and along annular chamber 70. As piston 14 moves within the displaced metering sleeve 28, metering ports 58 are again closed by throttling land 62 thereby blocking off fluid flow to low pressure cavity 68. Thereafter, the remaining fluid flow resulting from the upward stroke of piston 14 is discharged through outlet port 56 as previously described.

The adjustable metering sleeve 28 is moved to its maximum upward position when the pressure in the hydraulic system reaches a maximum predetermined level. The only flow to the hydraulic system through port 56 at the maximum desired system pressure is that necessary to maintain the desired pressure. All other flow will be diverted through metering port 58 to the low pressure cavity 68. Thus, piston 14 delivers its full fluid volume to the hydraulic system through discharge port 56 until the pressure in the hydraulic system offsets the preload pressure from spring 60 on metering sleeve 28. At this point, metering sleeve 28 moves upwardly thereby permitting the opening of metering ports 58 such that the fluid flow out port 56 is reduced in proportion to increased system pressure until a maximum desired output pressure is reached with minimum fluid flow.

It will be apparent to those skilled in the art that the foregoing disclosure is exemplary in nature rather than limiting, the invention being limited only by the appended claims.

I claim:

1. A variable volume pump for satisfying the fluid flow requirements of a hydraulic system while absorbing excess fluid volume when the full volume of fluid displacement from the pump is not required by the hydraulic system, said pump including at least one piston vertically movable within a housing and said piston including a tube portion, said piston being slidably mounted by a free riding slipper member on a rotatable substantially hollow crankpin having an aperture, said piston including an enlarged spherical head with an axial drilling therethrough, and fluid being fed through said aperture and axial drilling into said piston for filling said piston tube portion, and fluid communication between said aperture and piston tube portion being broken during rotation of said crankpin and corresponding vertical movement of said piston, said piston tube portion being movable within a metering sleeve, said tube portion having a plurality of metering ports around its periphery, said metering sleeve being preloaded by spring means towards a position where a throttling land on said metering sleeve covers said metering ports, said metering sleeve being slidably mounted on a support member having an opening therethrough, a return spring mounted within said piston tube portion in abutting engagement against one end of said support member for holding said piston in position on said crankpin, the fluid filling said piston tube portion being delivered into said support member opening and directed against a check valve, said check valve being spring biased against a seat, said check valve being forced off said seat when the fluid pressure in said piston tube portion exceeds the spring load against said check valve for discharging the fluid filling said piston tube portion to said hydraulic system when the fluid pressure in said hydraulic system is less than the fluid presure in said piston tube portion, means for communicating the fluid pressure in said hydraulic system against an annular abutment on said metering sleeve, said metering sleeve being movable to a displaced position when the fluid pressure in said hydraulic system exceeds the preload on said metering sleeve, the movement of said metering sleeve to said displaced position permitting said piston to travel an equal distance with said metering ports uncovered thereby resulting in the displacement of a fluid volume from said piston along an annular chamber between said tube portion and said housing to a low pressure cavity within said pump until the metering ports are again covered by said throttling land whereby the fluid flow from said pump being reduced in proportion to increased fluid pressure in said hydraulic system .

* * * * *